US007451818B2

(12) United States Patent
Addis et al.

(10) Patent No.: US 7,451,818 B2
(45) Date of Patent: Nov. 18, 2008

(54) METHOD OF REDUCING SAND PRODUCTION FROM A WELLBORE

(75) Inventors: Michael Anthony Addis, Rijswijk (NL); Chengho Abel Lee, Rijswijk (NL); Victor Arkady Dunayevsky, Houston, TX (US); Daniel Frederick Fehler, Houston, TX (US); Mohamad Fereydoon Khodaverdian, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 273 days.

(21) Appl. No.: 10/578,730

(22) PCT Filed: Nov. 10, 2004

(86) PCT No.: PCT/EP2004/052899

§ 371 (c)(1),
(2), (4) Date: May 10, 2006

(87) PCT Pub. No.: WO2005/047645

PCT Pub. Date: May 26, 2005

(65) Prior Publication Data

US 2007/0079967 A1 Apr. 12, 2007

(30) Foreign Application Priority Data

Nov. 12, 2003 (EP) ..... 03257143

(51) Int. Cl.
*E21B 43/26* (2006.01)
*E21B 43/114* (2006.01)

(52) U.S. Cl. ..... 166/298; 166/50; 166/250.1; 166/297; 166/308.1; 299/17

(58) Field of Classification Search ..... 166/50, 166/250.01, 250.1, 297, 308.1, 298; 175/61, 175/62; 299/17
See application file for complete search history.

(56) References Cited

U.S. PATENT DOCUMENTS

| | | | | |
|---|---|---|---|---|
| 3,605,924 | A * | 9/1971 | Donegan | 175/400 |
| 4,708,214 | A * | 11/1987 | Krawza et al. | 175/424 |
| 5,335,724 | A * | 8/1994 | Venditto et al. | 166/298 |
| 5,337,825 | A | 8/1994 | Marmorstein et al. | 166/307 |
| 5,386,875 | A | 2/1995 | Venditto et al. | 166/308 |
| 5,787,983 | A * | 8/1998 | Heathman et al. | 166/244.1 |
| 6,283,214 | B1 | 9/2001 | Guinot et al. | 166/297 |
| 6,651,741 | B2 * | 11/2003 | Bassin et al. | 166/268 |
| 7,025,141 | B1 * | 4/2006 | Grebennikov et al. | 166/298 |
| 2003/0070805 | A1 | 4/2003 | Bassin et al. | 166/250.02 |
| 2003/0168216 | A1 | 9/2003 | Nicholson | 166/297 |
| 2004/0206493 | A1 * | 10/2004 | Zupanick et al. | 166/245 |
| 2004/0256158 | A1 * | 12/2004 | Edscer | 175/57 |

FOREIGN PATENT DOCUMENTS

| | | |
|---|---|---|
| EP | 0825538 | 2/1998 |
| SU | 1031263 | 12/1993 |

OTHER PUBLICATIONS

International Search Report PCT/EP2004/052899 dated Jan. 28, 2005.

* cited by examiner

*Primary Examiner*—George Suchfield

(57) ABSTRACT

A method is provided for the reduction of inflow of rock particles from an earth formation into a wellbore for the production of hydrocarbon fluid. The method comprises creating a zone of reduced compressive stiffness around the wellbore by removing rock material from the wall of the wellbore.

14 Claims, 2 Drawing Sheets

METHOD OF REDUCING SAND PRODUCTION FROM A WELLBORE

The present application claims priority on European Patent Application 03257143.2 filed Nov. 12, 2003.

FIELD OF THE INVENTION

The present invention relates to a method of reducing inflow of rock particles from an earth formation into a wellbore for the production of hydrocarbon fluid.

BACKGROUND OF THE INVENTION

Often the reservoir rock is loosely consolidated, so that it tends to disintegrate and flow into the wellbore under the influence of hydrocarbon fluid flowing through the pore spaces.

Such inflow of rock particles, generally referred to as sand production, is a frequently occurring problem in the industry of hydrocarbon fluid production, as the produced sand particles tend to erode production equipment such as tubings and valves. Conventional methods of sand control include the installation of supporting perforated liners or screens, which allow the hydrocarbon fluid to pass but exclude the sand particles. Also, gravel packs are installed between the liners or screens and the wellbore wall to control sand production. Although such liners, screens and gravel packs have often been successfully applied, there are potential drawbacks such as clogging of the perforations, screens or gravel packs leading to diminished fluid production. Hence there is a need for an improved method of sand control.

U.S. Pat. Nos. 5,337,825 and 5,386,875 and U.S. patent application US 2003/0070805 disclose methods wherein stresses in the formation surrounding a wellbore are alleviated by means of shots or fractures with essentially parallel walls.

SUMMARY OF THE INVENTION

The present inventions include a method of reducing inflow of rock particles from an earth formation into a wellbore for the production of_hydrocarbon fluid, the method comprising creating a zone of reduced compressive stiffness around the wellbore by removing rock material from the wall of the wellbore, wherein the step of removing rock material from the wellbore wall comprises creating a slot in the wellbore wall wherein the slot is wedge shaped in a cross-sectional plane of the wellbore, and that the width of the slot decreases in radially outward direction.

Preferably each elongate section has a longitudinal axis extending in axial direction of the wellbore.

It is to be understood that the elongate section does not need to extend parallel to the longitudinal axis of the wellbore, but can, for example, extend in the form of a helix along the wellbore wall.

Generally the earth formation surrounding the wellbore is subjected to stresses including first, second and third principal stresses. It is preferred that said elongate section extends radially in a direction substantially perpendicular to a selected one of said principal stresses.

Suitably said elongate section extends radially in a direction substantially perpendicular to the largest a selected one of said principal stresses.

In case the wellbore extends substantially vertically, it is preferred that said elongate section extends radially in a direction substantially perpendicular to the largest horizontal principal stress.

In case the wellbore extends substantially horizontally, it is preferred that said elongate section extends radially in a direction substantially perpendicular to the vertical principal stress.

The slots or perforations can be open (i.e. filled with gas or liquid) or filled with a flexible material.

BRIEF DESCRIPTION OF THE DRAWINGS

The invention will be described hereinafter in more detail and by way of example, with reference to the accompanying drawings in which:

FIG. lA schematically shows a wellbore in which an embodiment of the method of the invention is applied, at an initial stage of the method;

Figure 2:
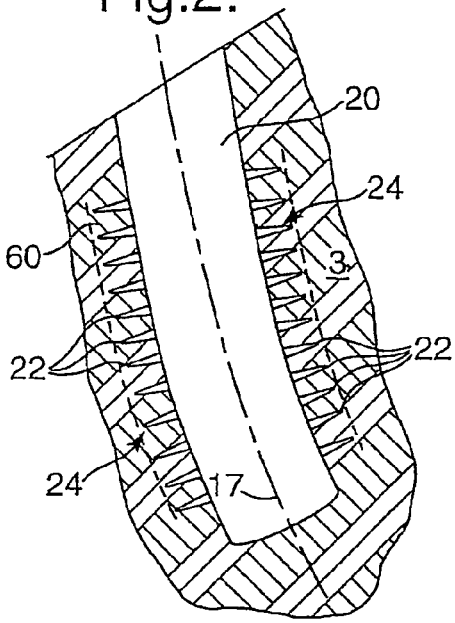
Figure 3:
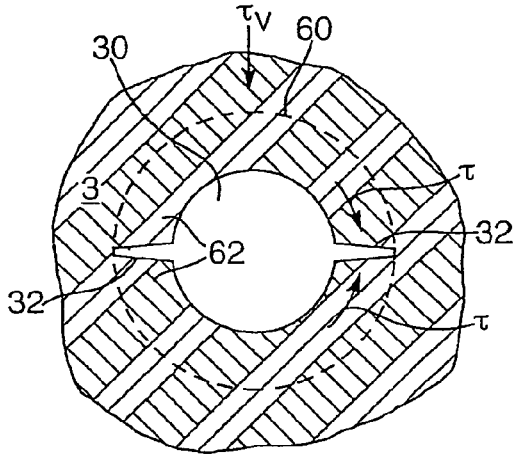
Figure 4:
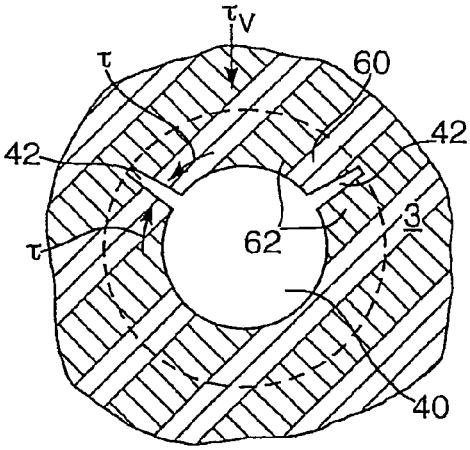
Figure 5:
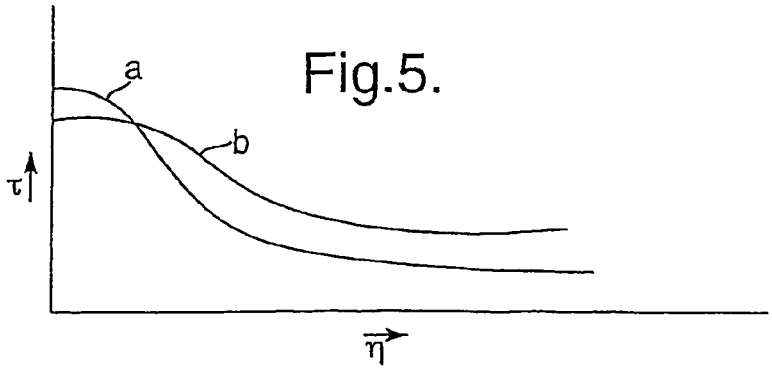

FIG. lB shows the wellbore of FIG. lA at a final stage of the method;

FIG. 2 schematically shows a lower portion of a wellbore in which an alternative embodiment of the method of the invention has been applied;

FIG. 3 schematically shows a cross-section of a horizontal wellbore provided with slots extending in a substantially horizontal plane;

FIG. 4 schematically shows a cross-section of a horizontal wellbore provided with slots extending at an angle to a vertical plane; and FIG. 5 schematically shows a diagram indicating shear stresses in the rock formation around the wellbore as a function of the radial distance from the wellbore wall.

DETAILED DESCRIPTION OF THE INVENTION

In the Figures, like reference signs relate to like components.

Figure 1A:
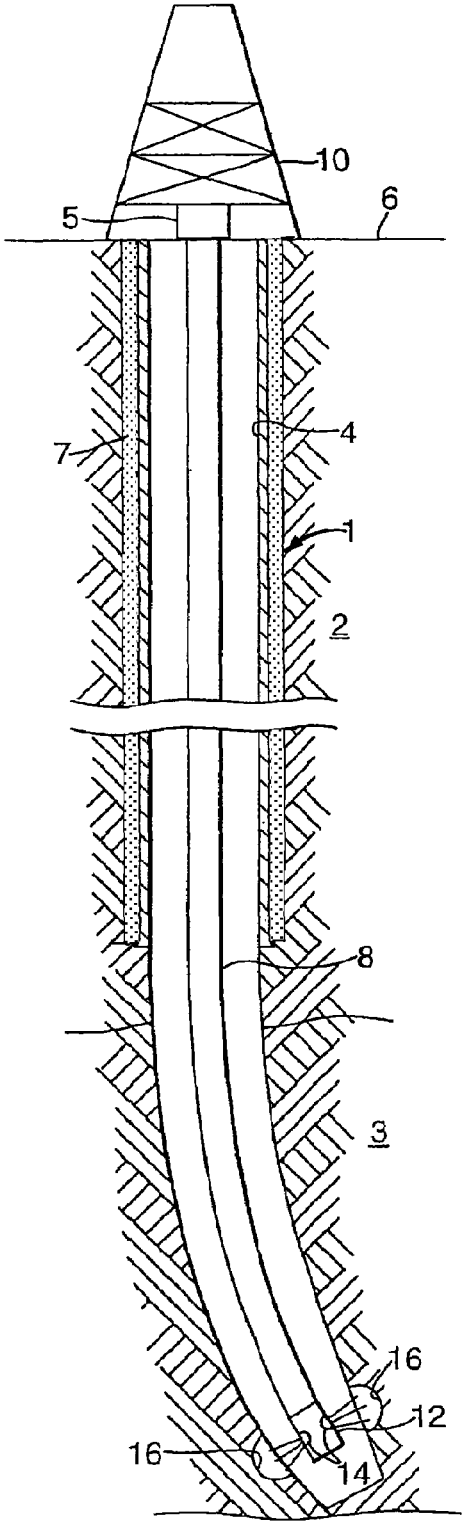

Referring to FIG. 1A there is shown a wellbore 1 for the production of hydrocarbon fluid, the wellbore 1 extending into in an earth formation 2 including a formation zone 3 containing hydrocarbon fluid. The wellbore 1 is provided with a casing 4 extending from a wellhead 5 at the earth surface 6 to near the upper end of the formation zone 3. The casing 4 is fixed in the wellbore by a layer of cement 7 located between the wellbore wall and the casing 4. An injection string 8 for injecting cutting fluid extends from a drill rig 10 at surface, into the wellbore 1. The injection string 8 is at the lower end thereof provided with a fluid jet cutter 12 having a pair of jetting nozzles 14 oppositely arranged each other. The fluid jet cutter 12 is located near the lower end of the formation zone 3. Fluid jets 16 are ejected from the nozzles 14 against the wall of the wellbore 1 thereby creating slots 16 oppositely arranged in the wellbore wall.

Figure 1B:
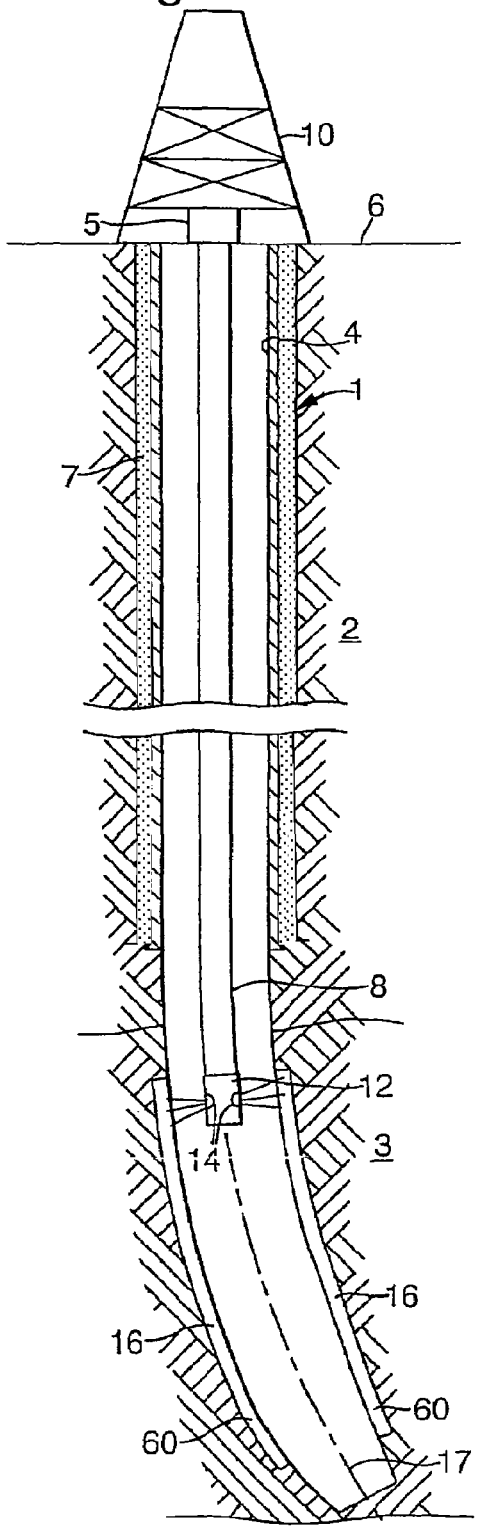

In FIG. 1B is shown the wellbore 1 after the injection string 8 has been raised to a position whereby the fluid jet cutter 12 is located near the upper end of the formation zone 3. The slots 16 extend in axial direction 17 of the wellbore 1 and along substantially the whole length of the section of the wellbore 1 passing through the formation zone 3.

In FIG. 2 is shown a lower portion of a wellbore 20 provided with a plurality of closely spaced perforations 22 in the wall of the wellbore 20. The perforations 22 are arranged so as to form two opposite rows of perforations 24, the rows 24 extending in axial direction of the wellbore 20.

In FIG. 3 is shown a cross-section of a substantially horizontal wellbore section 30 passing through the formation zone 3. The formation zone 3 is subjected to in-situ stresses of which the vertical principal stress ($\sigma v$) has the largest magnitude. The presence of the wellbore 30 in the formation zone 3 causes stress concentrations whereby the highest shear stresses (τ) occur near the wellbore wall, about halfway the top and the bottom of the horizontal wellbore section 30. Slots 32 have been formed in the wall of the wellbore section 30, the slots being oppositely arranged and extending in axial direction of the wellbore section 30.

In FIG. 4 is shown a cross-section of a substantially horizontal wellbore section 40 passing through the formation zone 3. The formation zone 3 is subjected to in-situ stresses including the vertical principal stress (σv) having the largest magnitude. Stress concentrations occur due to the presence of the wellbore 40 in the formation zone 3, causing relatively high shear stresses (τ) near the wellbore wall. Slots 42 have been formed in the wall of the wellbore section 40, the slots 42 being formed in the upper half of the wellbore wall in a manner that each slot 42 extends at about 45 degrees to the vertical.

In FIG. 5 is shown a diagram indicating the shear stresses τ in the formation zone around the wellbore as a function of the radial distance r from the wellbore wall. Curve (a) indicates the shear stresses τ occurring in the formation zone if no slots are present in the wellbore wall, and curve (b) indicates the shear stresses τ occurring in the formation zone if slots are present in the wellbore wall. The diagram is intended for comparison of the curves (a) and (b) only, therefore no scale has been indicated along the axes and no measurement units for the variables τ and r have been indicated.

During normal use the wellbore 1 is drilled to a depth near the hydrocarbon fluid containing formation zone 3, the casing 4 is installed, and cement is pumped between the casing 4 and the wellbore wall to form the layer of cement 7. Subsequently the wellbore 1 is further drilled through the formation zone 3. Before production of hydrocarbon fluid from formation zone 3 is commenced, the injection string 8 is lowered into the wellbore 1 such that the jet cutter 12 is located near the bottom of the wellbore 1 (FIG. 1A). Cutting fluid (e.g. water) is then pumped through the string 8, so as to induce the fluid jet cutter to jet two opposite jet streams against the wellbore wall. As a result the slots 16 are created in the wellbore wall. Simultaneously with pumping cutting fluid through the string 8, the string is gradually raised in the wellbore 1 until the jet cutter 12 is located near the upper end of the formation zone 3 (FIG. 1B). Thus the slots 16 are formed along substantially the whole length of the section of the wellbore 1 through the formation zone 3.

If the wellbore 1 extends substantially horizontally through the formation zone 3 (FIGS. 3, 4), the injection string 8 is raised through the wellbore 1 such that the jet cutter 12 cuts the slots 32, 42, 52 substantially along the whole length of the section of the wellbore 1 passing through the formation zone 3.

In the embodiment shown in FIG. 3, the jet cutter 12 is kept oriented in the wellbore 1 such that the nozzles 14 are positioned in a substantially horizontal plane during the cutting process.

In the embodiment shown in FIG. 4, a first alternative jet cutter (not shown) is used having nozzles positioned at an angle of about 90 degrees relative to each other, whereby the alternative jet cutter is kept oriented in the wellbore 1 such that the nozzles are positioned at about 45 degrees to the vertical during the cutting process.

Slots 16, 32, 42 or the rows of perforations 24, form an annular zone 60 of reduced compressive stiffness around the wellbore 1, 30, 40. The thickness of the zone 60 is about equal to the depth of the slots 16, 32, 42 or the perforations of the rows 24. The compressive stiffness of the zone 60 is reduced because the slots 16, 32, 42 form open spaces between sections of rock 62, which open spaces allow some circumferential compression of the annular zone 60 under the effect of the governing formation stresses. As a result the stresses in the annular zone 60 sections of rock material 62 between the slots 16, 32, 42 are relieved somewhat. By the reduction of the stresses in the annular zone 60, the stresses m the rock material outside the annular zone 60 increase somewhat as schematically illustrated in FIG. 6. However, the stresses outside the annular zone 60 are relatively low so that a limited increase of these stresses has no adverse effects.

With the method of some embodiments of the invention it is achieved that the relatively high shear stresses near the wellbore wall are relaxed, so that the tendency of local failure of rock material near the wellbore wall is reduced. It will be appreciated that such reduced tendency of failure of rock material near the wellbore wall leads to a desired reduction of inflow of rock particles (sand particles) into the wellbore during the production of hydrocarbon fluid from the earth formation zone.

Instead of creating slots or rows of perforations, in the open-hole section of a wellbore, such slots or rows of perforations suitably can be formed in the rock formation behind a perforated liner or casing.

Instead of creating the slots using the jet cutter described hereinbefore, the slots can be created by a mechanical device such as a chain saw, or by an explosive charge.

Instead of the elongate section extending parallel to the longitudinal axis of the wellbore, or in the form of a helix along the wellbore wall, the elongate section can extend in a plane substantially perpendicular to the longitudinal axis of the wellbore. Thus, in such embodiment the elongate section has a circular shape.

It is thereby achieved that stress concentrations in the rock material at, or adjacent to, the wellbore wall are relieved. Such stress concentrations are due to the presence of the wellbore in the rock formation, whereby the originally undisturbed stresses in the rock formation have become disturbed. The disturbed stresses include high shear stresses in the near wellbore region, which often lead to local failure of the rock formation thereby inducing sand production. By reducing the compressive stiffness in a zone around the wellbore, the relatively high shear stresses in the near-wellbore region are relieved so that the risk of local failure of the rock formation is reduced.

It is preferred that the step of removing rock material from the wellbore wall is carried out in an open-hole section of the wellbore, that is to say, an uncased section of the wellbore.

Suitably the step of removing rock material from the wellbore wall comprises removing rock material from at least one elongate section of the wellbore wall.

Preferably each elongate section has a longitudinal axis extending in axial direction of the wellbore.

It is to be understood that the elongate section does not need to extend parallel to the longitudinal axis of the wellbore, but can, for example, extend in the form of a helix along the wellbore wall.

Generally the earth formation surrounding the wellbore is subjected to stresses including first, second and third principal stresses. it is preferred that said elongate section extends radially in a direction substantially perpendicular to a selected one of said principal stresses.

Suitably said elongate section extends radially in a direction substantially perpendicular to the largest a selected one of said principal stresses.

In case the wellbore extends substantially vertically, it is preferred that said elongate section extends radially in a direction substantially perpendicular to the largest horizontal principal stress.

In case the wellbore extends substantially horizontally, it is preferred that said elongate section extends radially in a direction substantially perpendicular to the vertical principal stress.

The slots or perforations can be open (i.e. filled with gas or liquid) or filled with a flexible material.

We claim:

1. A method of reducing inflow of rock particles from an earth formation into a wellbore for the production of hydrocarbon fluid, the method comprising creating a zone of reduced compressive stiffness around the wellbore by removing rock material from the wall of the wellbore, wherein the step of removing rock material from the wellbore wall comprises creating a slot in the wellbore wall; wherein the slot is wedge shaped in a cross-sectional plane of the wellbore, and the width of the slot decreases in a radially outward direction.

2. The method of claim 1, wherein the rock material is removed from the wellbore wall in an open-hole portion of the wellbore.

3. The method of claim 2, wherein the step of removing rock material from the wellbore wall comprises removing rock material from at least one elongate section of the wellbore wall.

4. The method of claim 1, wherein the step of removing rock material from the wellbore wall comprises removing rock material from at least one elongate section of the wellbore wall.

5. The method of claim 4, wherein each said elongate section has a longitudinal axis extending in axial direction of the wellbore.

6. The method of claim 5, wherein the earth formation surrounding the wellbore is subjected to stresses including first, second and third principal stresses, and wherein said elongate section extends radially in a direction substantially perpendicular to a selected one of said principal stresses.

7. The method of claim 4, wherein the earth formation surrounding the wellbore is subjected to stresses including first, second and third principal stresses, and wherein said elongate section extends radially in a direction substantially perpendicular to a selected one of said principal stresses.

8. The method of claim 7 wherein said elongate section extends radially in a direction substantially perpendicular to the largest one of said principal stresses.

9. The method of claim 8 wherein the wellbore extends substantially vertically, and wherein said elongate section extends radially in a direction substantially perpendicular to the largest horizontal principal stress.

10. The method of claim 8 wherein the wellbore extends substantially horizontally, and wherein said elongate section extends radially in a direction substantially perpendicular to the vertical principal stress.

11. The method of claim 7 wherein the wellbore extends substantially vertically, and wherein said elongate section extends radially in a direction substantially perpendicular to the largest horizontal principal stress.

12. The method of claim 7 wherein the wellbore extends substantially horizontally, and wherein said elongate section extends radially in a direction substantially perpendicular to the vertical principal stress.

13. The method of claim 1, wherein the step of creating the slot includes a) lowering a string provided with a fluid jet cutter into the wellbore;

b) pumping a fluid through the string so as to induce the fluid jet cutter to eject a fluid jet against the wall of the wellbore thereby creating a cut in the wellbore wall; and c) simultaneously with step b, moving the string in axial direction through the wellbore.

14. The method of claim 1, wherein the slot substantially extends in axial direction of the wellbore.

* * * * *